US005971475A

United States Patent [19]

Lawson et al.

[11] Patent Number: 5,971,475

[45] Date of Patent: Oct. 26, 1999

[54] THREE-WAY INCLINER

[75] Inventors: Gregory M. Lawson; Stephen R. Lake, both of Tupelo, Miss.

[73] Assignee: Omega Motion LLC, Saltillo, Miss.

[21] Appl. No.: 08/985,014

[22] Filed: Dec. 4, 1997

Related U.S. Application Data

[60] Provisional application No. 60/032,110, Dec. 5, 1996.

[51] Int. Cl.[6] ..... A47C 1/02

[52] U.S. Cl. ..... 297/85; 297/68

[58] Field of Search ..... 297/85, 68, 83, 297/84, 340, 341, 342

[56] References Cited

U.S. PATENT DOCUMENTS 3,637,255 1/1972 Re .
4,195,878 4/1980 Cycowicz et al. .
4,531,778 7/1985 Rogers .
4,815,788 3/1989 May .
4,904,019 2/1990 May .
5,056,862 10/1991 May et al. .
5,072,988 12/1991 Plunk .
5,147,108 9/1992 LaPointe .
5,419,611 5/1995 Cook .

*Primary Examiner*—Milton Nelson, Jr.
*Attorney, Agent, or Firm*—Wolf, Greenfield & Sacks, P.C.

[57] ABSTRACT

A reclining chair having a seat, backrest and footrest movable from upright to TV and fully reclined positions and having a mechanism which includes a track and roller at the rear and a linkage mechanism at the front enabling the seat, backrest and footrest to move from one position to another. The mechanism is gravity operated by the weight of the chair occupant to move from upright to TV position, but is restrained by an over center latch which is manually actuated to release the mechanism.

17 Claims, 21 Drawing Sheets

THREE-WAY INCLINER

RELATED APPLICATION

This application claims the benefit of prior filed Provisional Application Ser. No. 60/032,110, filed Dec. 5, 1996, and entitled "Three-Way Incliner."

FIELD OF THE INVENTION

This invention relates to motion furniture and more particularly to three-way incliners.

BACKGROUND OF THE INVENTION

At the present time, the mechanisms used in reclining chairs generally fall into two categories, namely, those that employ linkages to support the seat and afford the ability to move the seat relative to the base, and those that employ tracks and rollers for that purpose. While the track and roller mechanism may be somewhat less expensive than the mechanisms which rely upon linkage assemblies to provide the motion, the track and roller systems require that the frames be manufactured to much closer tolerances than those employing linkages and, consequently, the manufacturing costs of motion furniture employing mechanisms with wheels and tracks are the more expensive and require more frequent repair.

The primary object of the present invention is to provide an improved recliner mechanism which is competitively priced with mechanisms employing track and roller systems and which reduces the manufacturing costs of motion furniture incorporating the improved mechanism.

In accordance with the present invention, the mechanism has a track and roller system at the rear and a linkage system at the front, supporting the seat mounting bracket of the mechanism on the base. This arrangement renders the frame dimensions of the chair less critical. This arrangement also makes the chair less susceptible to malfunction as a result of twisting of the mechanisms and frames, and reduces manufacturing costs.

DETAILED DESCRIPTION

Figure 1:
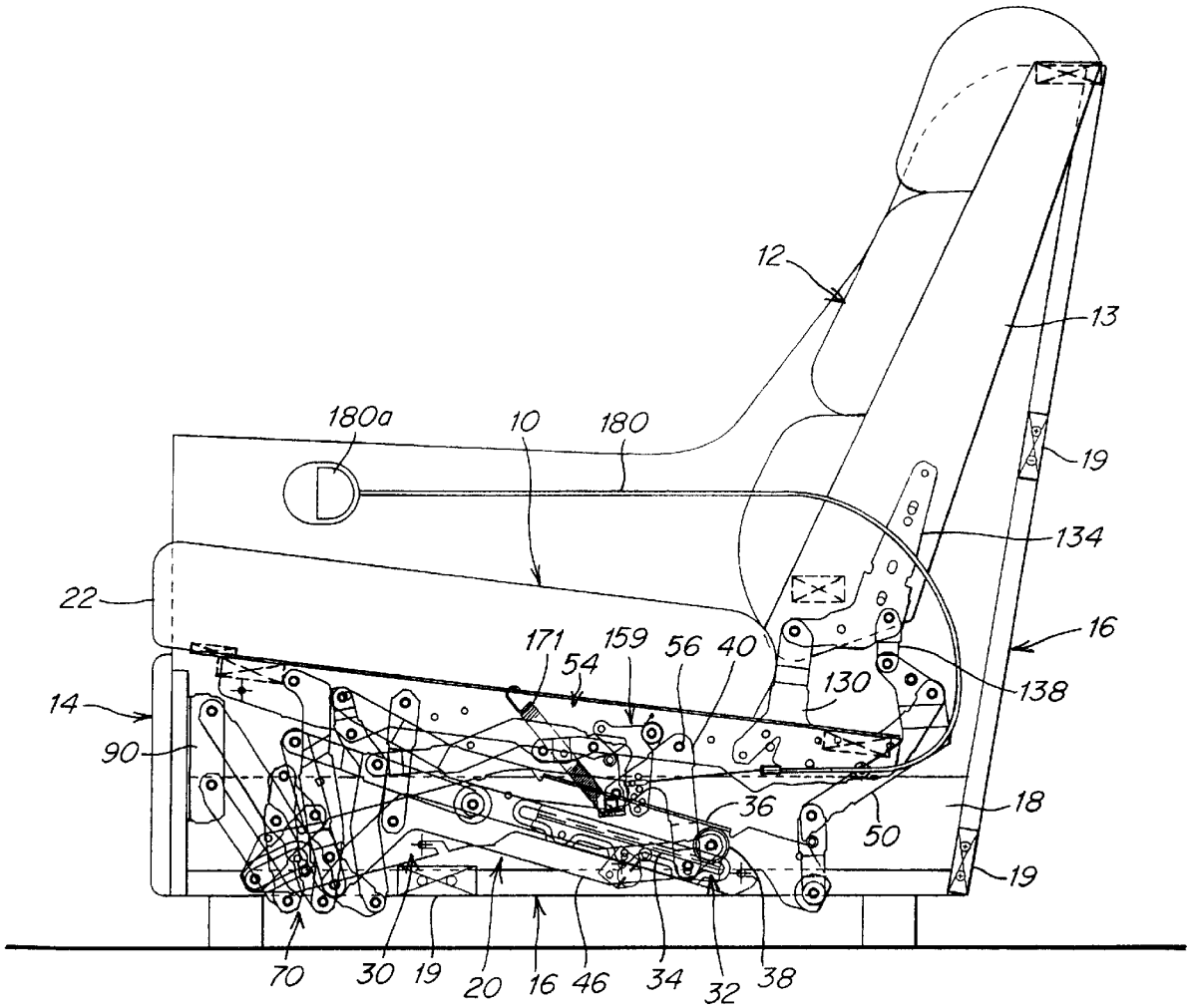
FIG. 1 is a side view of a three-way incliner chair constructed in accordance with the present invention and with the backrest, seat and footrest shown diagrammatically and with the incliner mechanism shown in detail and further, with the chair shown in the upright position.

The incliner chair shown on the drawing includes a seat 10, backrest 12, and footrest 14, all collectively mounted on a frame 16 having side rails 18 connected together by cross rails 19. The seat, backrest and footrest are all supported on a recliner mechanism 20 shown in detail in the drawings. The mechanism 20 enables the chair to move from the upright position shown in FIG. 1 to the intermediate or TV position shown in FIG. 2 and the fully reclined position shown in FIG. 3. When the chair moves from the upright to the TV position, the seat 10 and backrest 12 move as a unit somewhat forwardly and downwardly with respect to the frame 16 (compare FIGS. 1 and 2), and when the chair moves from the TV to the fully reclined position, the seat 10 moves forward essentially in the plane it occupied in the TV position while the backrest tilts rearwardly with respect to the seat (compare FIGS. 2 and 3). The footrest 14 elevates from a stored position beneath the seat when the chair is upright to an extended position beyond the front edge 22 of the seat when the chair moves from the upright to the TV position. The relative positions of the seat 10 and footrest 14 do not change as the chair continues to the fully reclined position.

While a single mechanism is shown in the drawings, it should be appreciated that duplicate mechanisms are mounted on each side of the chair. The two mechanisms are mirror images of one another and work together as the chair moves from one position to another. In the following description only a single mechanism is described, but it should be borne in mind that both function together.

Figure 3:
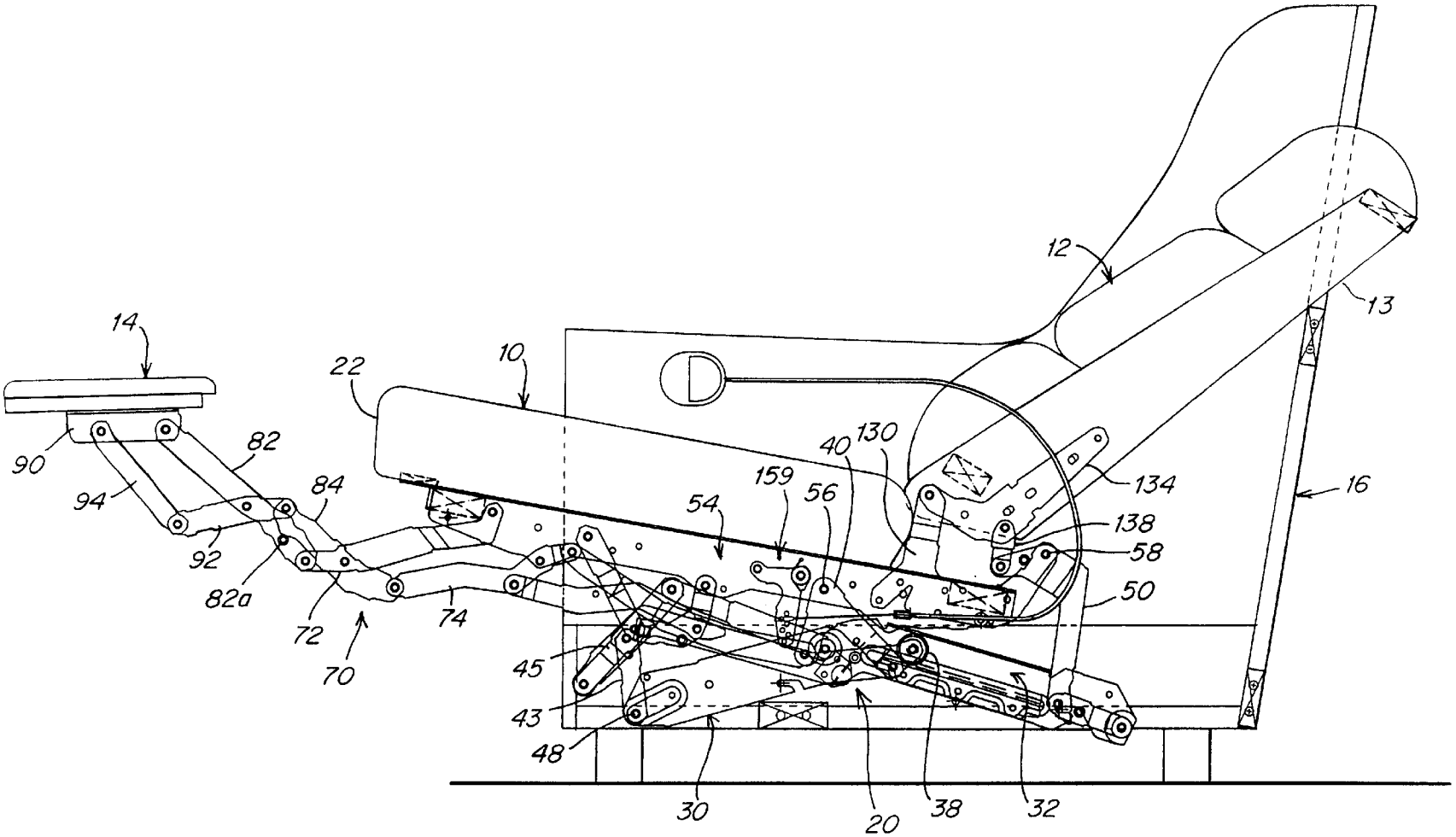
Figure 4:
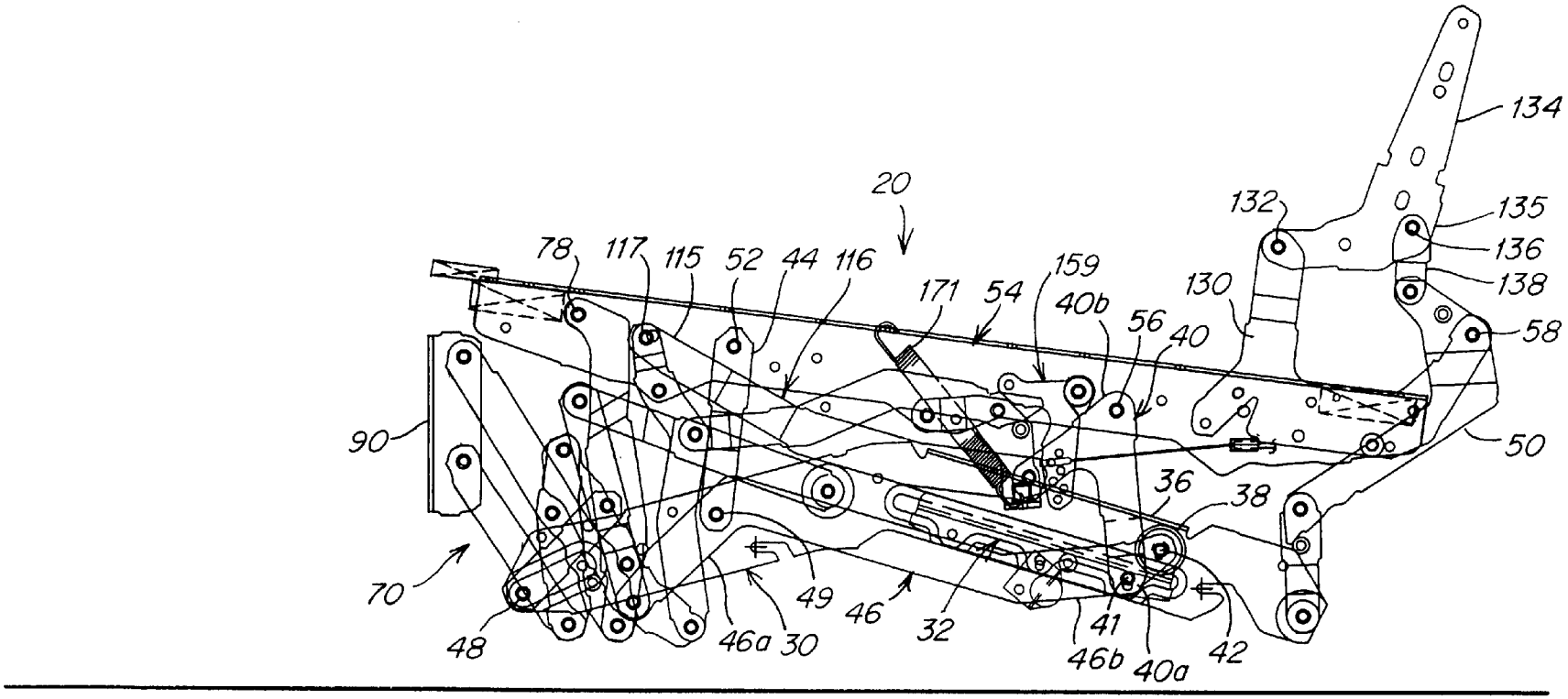
FIGS. 4–6 are enlarged side views of the mechanism shown in FIGS. 1–3 and with the mechanism in the upright, intermediate (TV) and fully reclined positions, respectively.
Figure 11:
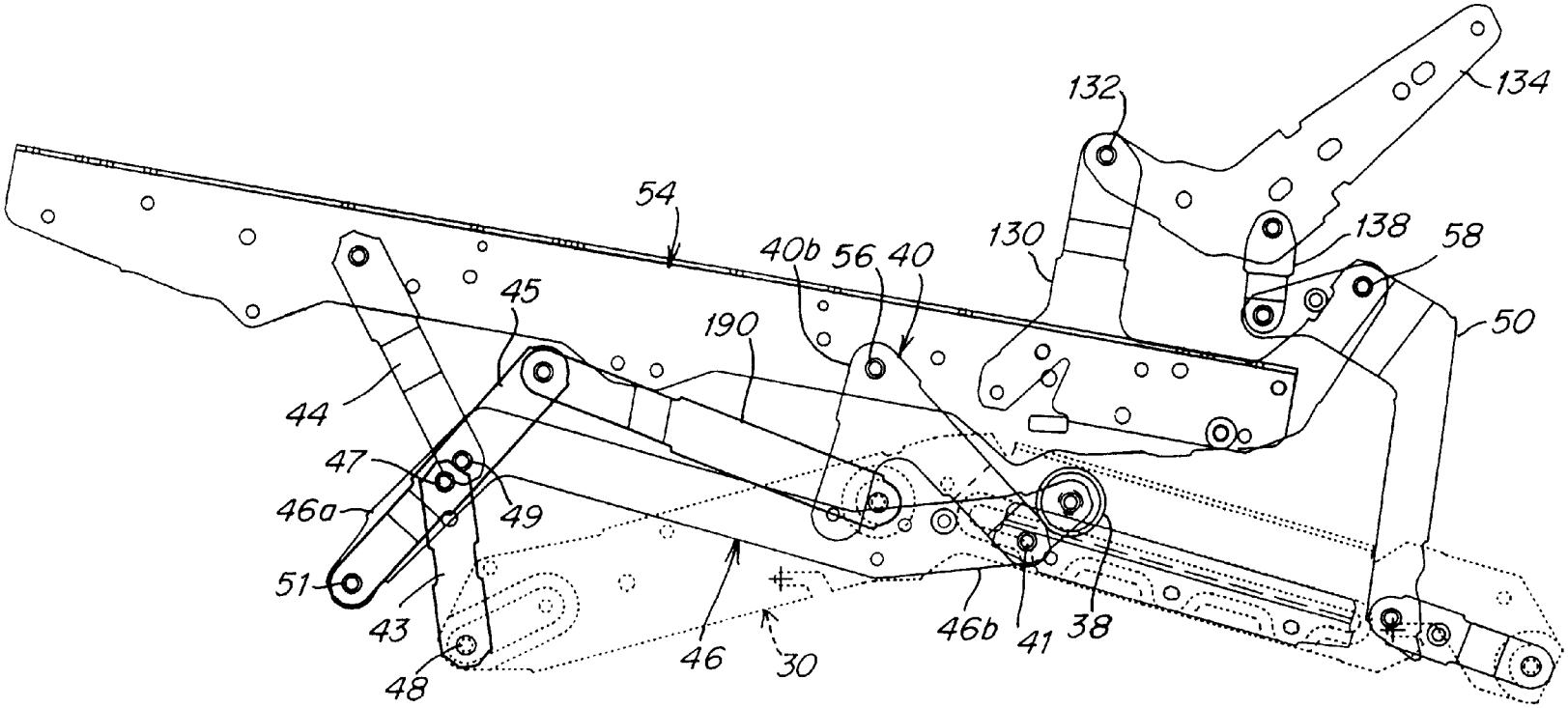
FIG. 11 is a view similar to FIG. 10 but with the mechanism in the fully reclined position.

The mechanism 20 is carried by a mounting link 30 which is secured in the inner surface of the side panel 18 of the frame 16. The mounting link 30 made of steel (as are all the other elements of the mechanism) is bolted to the side panel 18. The mounting link 30 carries a track 32 on its inner face defined in part by an angle member 34 riveted to the mounting link and a flange 36 formed as an integral part of the link 30. The track 32 is upwardly and forwardly inclined with respect to the chair and carries a roller 38 which may move from the rearward most position shown in FIGS. 1 and 4, in a forward direction up the track to the extreme forward position shown in FIGS. 3 and 6. The roller 38 in turn carries a trolley 46 pivotally mounted on the shaft 42 of the roller 38. The front end 46*a* of the trolley 46 is supported on the fixed mounting link 30 by lower and upper travel links 43 and 45 as clearly shown in FIGS. 5 and 11. Specifically, pivot 48 joins the lower end of lower travel link 43 to the mounting link 30 and pivot 49 joins the upper end of the lower travel link 43 to the mid-portion of upper travel link 45. The lower end of the upper travel link 45 in turn is connected to the front end 46*a* of the trolley by pivot 51.

A crank-shaped rear pivot link 40 is pivotally connected first one end 40*a* by pivot 41 to the rear end 46*b* of the trolley 46, and the elbow 40*b* of the pivot link 40 is connected by pivot 56 to seat mounting bracket 54. A front pivot link 44 is pivotally mounted adjacent the front end 46*a* of the trolley 46 at pivot 49. The opposite end of front pivot link 44 is pivotally connected at pivot 52 to the seat mounting bracket 54. The front pivot link 44 and the rear pivot link 40 together support the seat mounting bracket.

Figure 5:
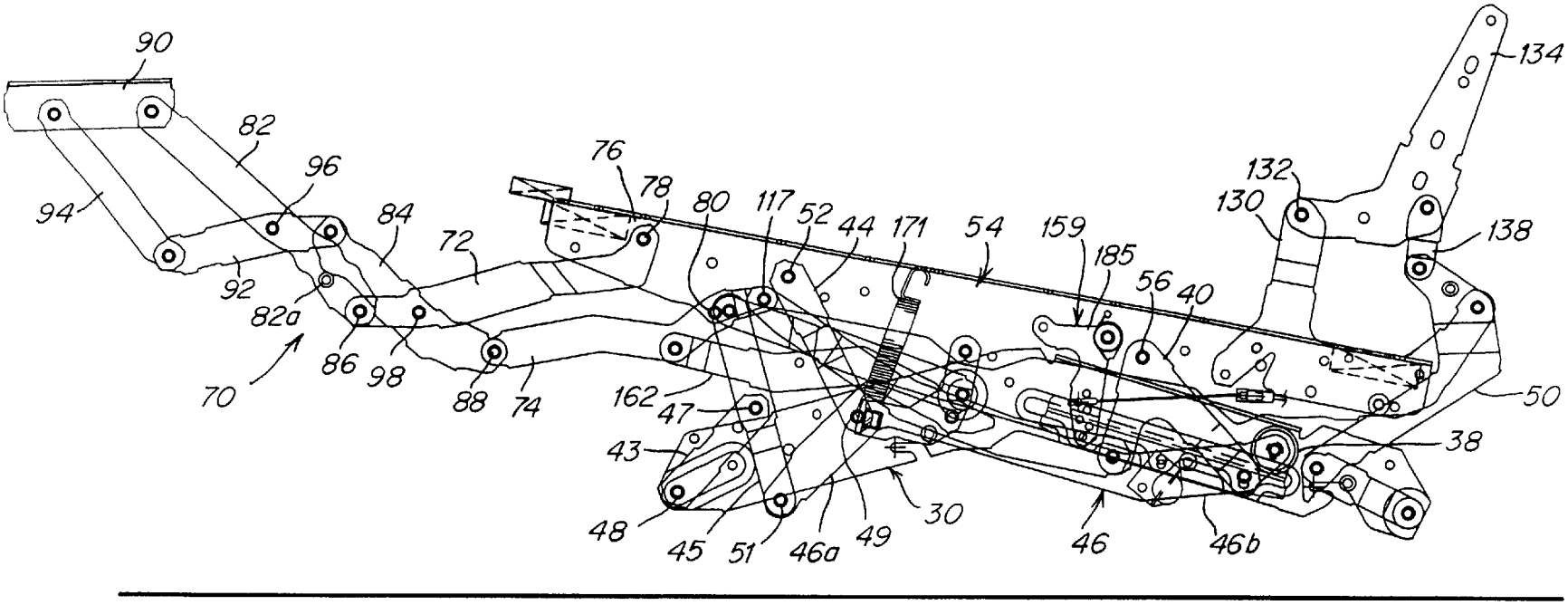
Figure 6:
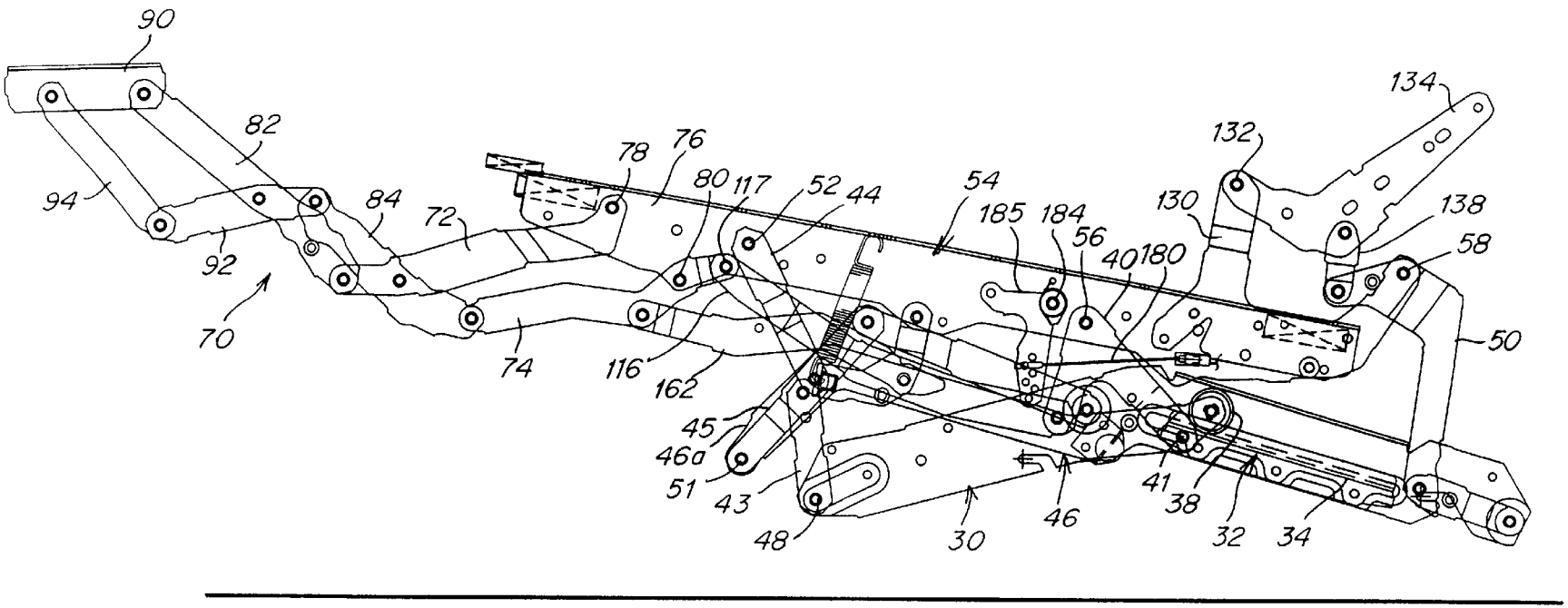
Figure 7:
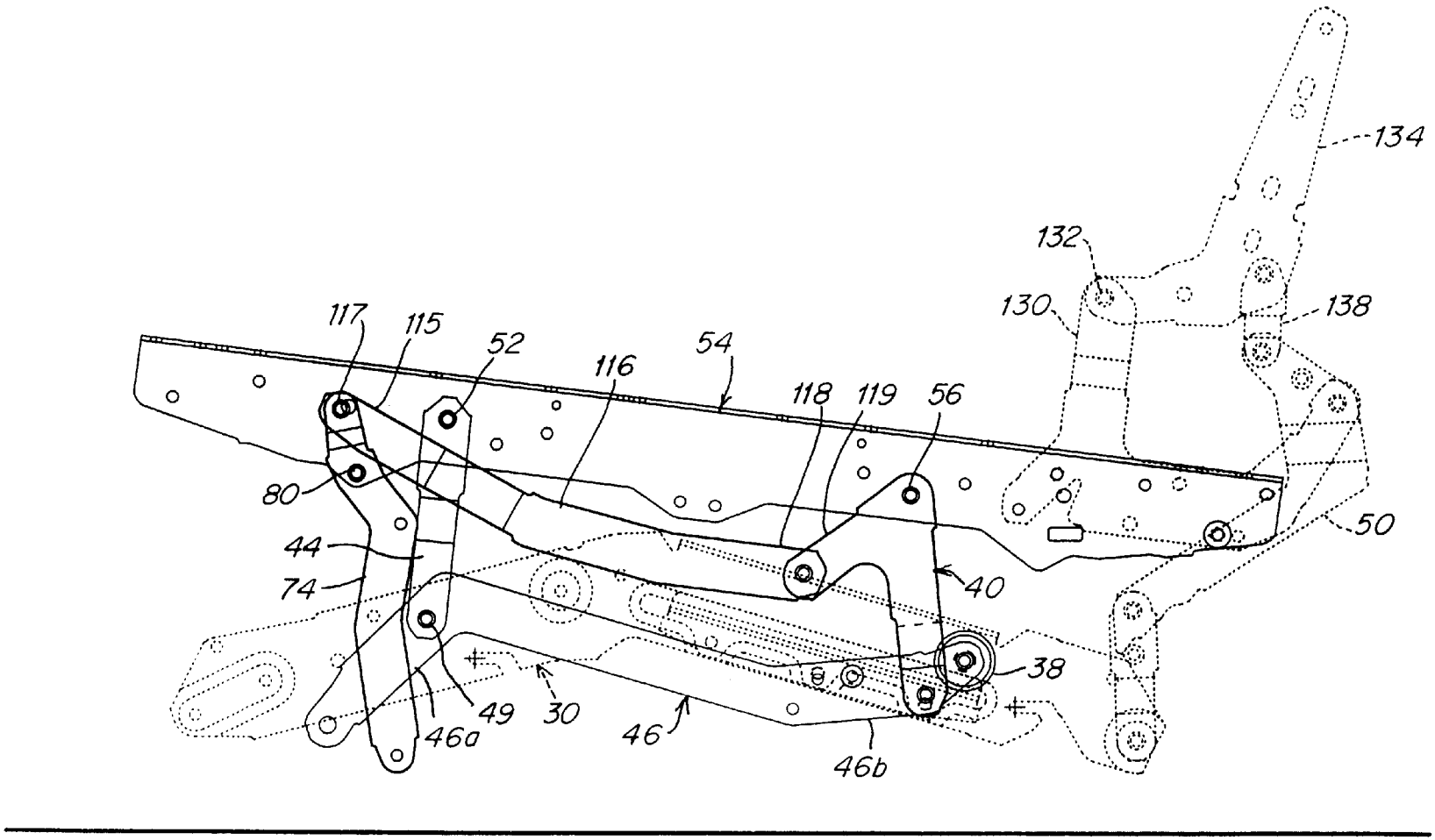
FIG. 7 is a fragmentary side view of the mechanism shown in FIGS. 1–6 and particularly showing the footrest drive assembly in full lines while other parts of the mechanism are shown in broken lines, and with the mechanism in the footrest in a retracted position.
Figure 8:
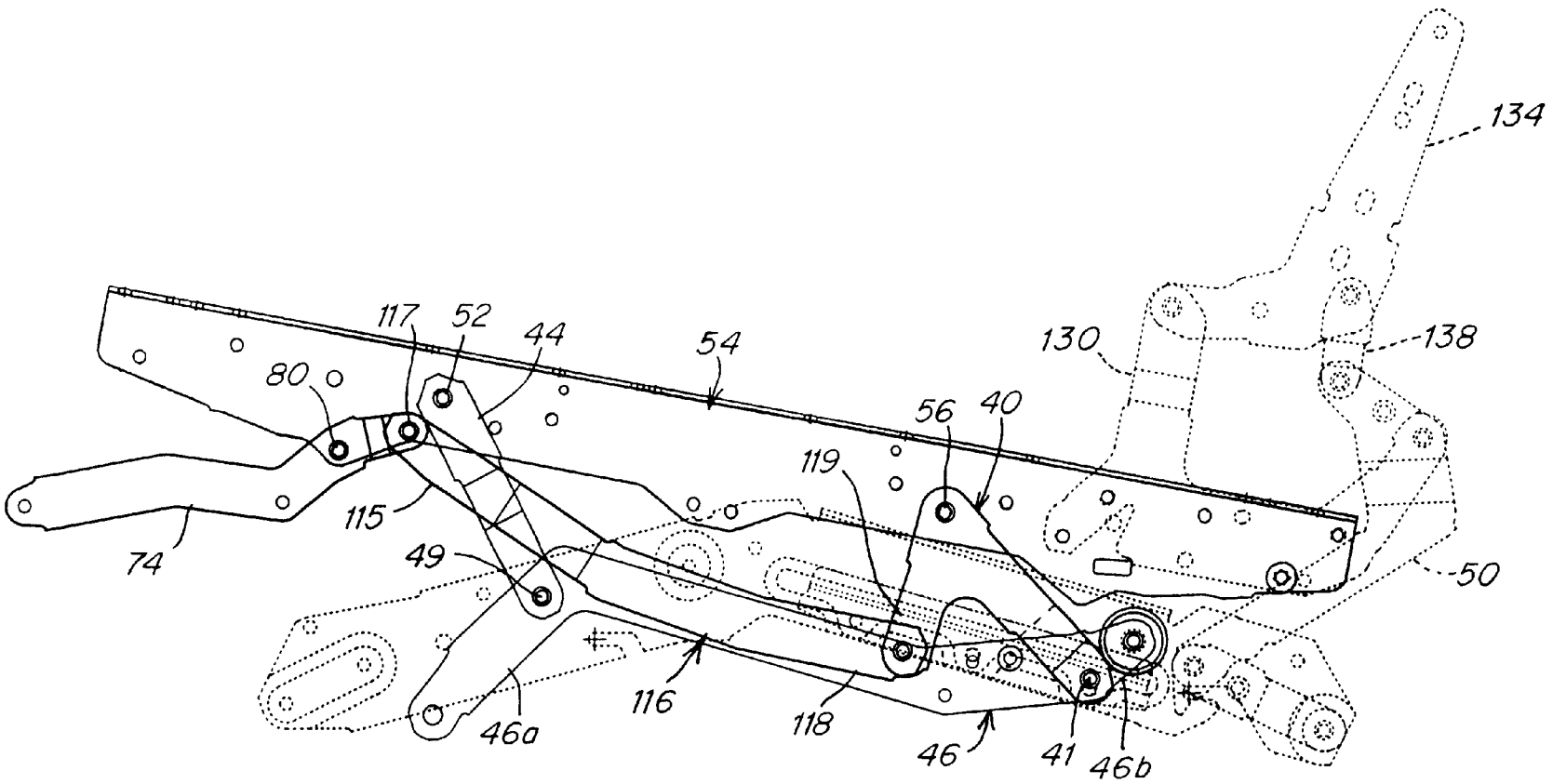
FIG. 8 is a view similar to FIG. 7 but with the mechanism in the intermediate position and with the footrest drive assembly extended.

The footrest 14 is carried by a lazy tong linkage 70 made up of front and rear footrest swing links 72 and 74 each pivotally mounted at one end on the front end 76 of the seat mounting bracket 54 at 78 and 80, respectively, as best shown in FIGS. 5 and 6. The swing links 72 and 74 are pivotally connected at their other ends to the ends of links 82 and 84 at pivots 86 and 88. The link 82 in turn is connected at its other end to the footrest mounting bracket 90. The other end of link 84 is connected to a pair of folding links 92 and 94. The link 94 in turn is also connected to the footrest mounting bracket 90. The links 82 and 92 are interconnected by pivot 96 intermediate their ends, and the front swing link 72 and the link 84 are connected intermediate their ends by pivot 98. The lazy tong linkage acts as a pantograph to move the footrest from a retracted position beneath the seat (FIGS. 1 and 4) to an extended position generally in the plane of the seat and forward of the front portion 22 thereof. As most clearly shown in FIGS. 7 and 8, footrest drive link 116 is pivotally connected at its front end 115 by pivot 117 to the rear footrest swing link 74 and at its rear end 118 to the end 119 of the rear pivot link 40. The manner in which the footrest drive link functions to elevate the footrest is described in detail below in the description of the operation of the mechanism.

Adjacent its back end, the seat mounting bracket 54 carries a generally horse shoe shaped bracket 130 which is riveted to and moves with the seat mounting bracket 54. The bracket 130 at its upper end by means of pivot 132 pivotally supports the backrest mounting link 134 on which the backrest 12 with its frame 13 is attached. The rear corner 135 of the backrest mounting link 134 is pivotally connected at 136 to the top end of the back drive link 138 that in turn is connected at its lower end by pivot 140 to one end of the bellcrank 50.

Figure 9:
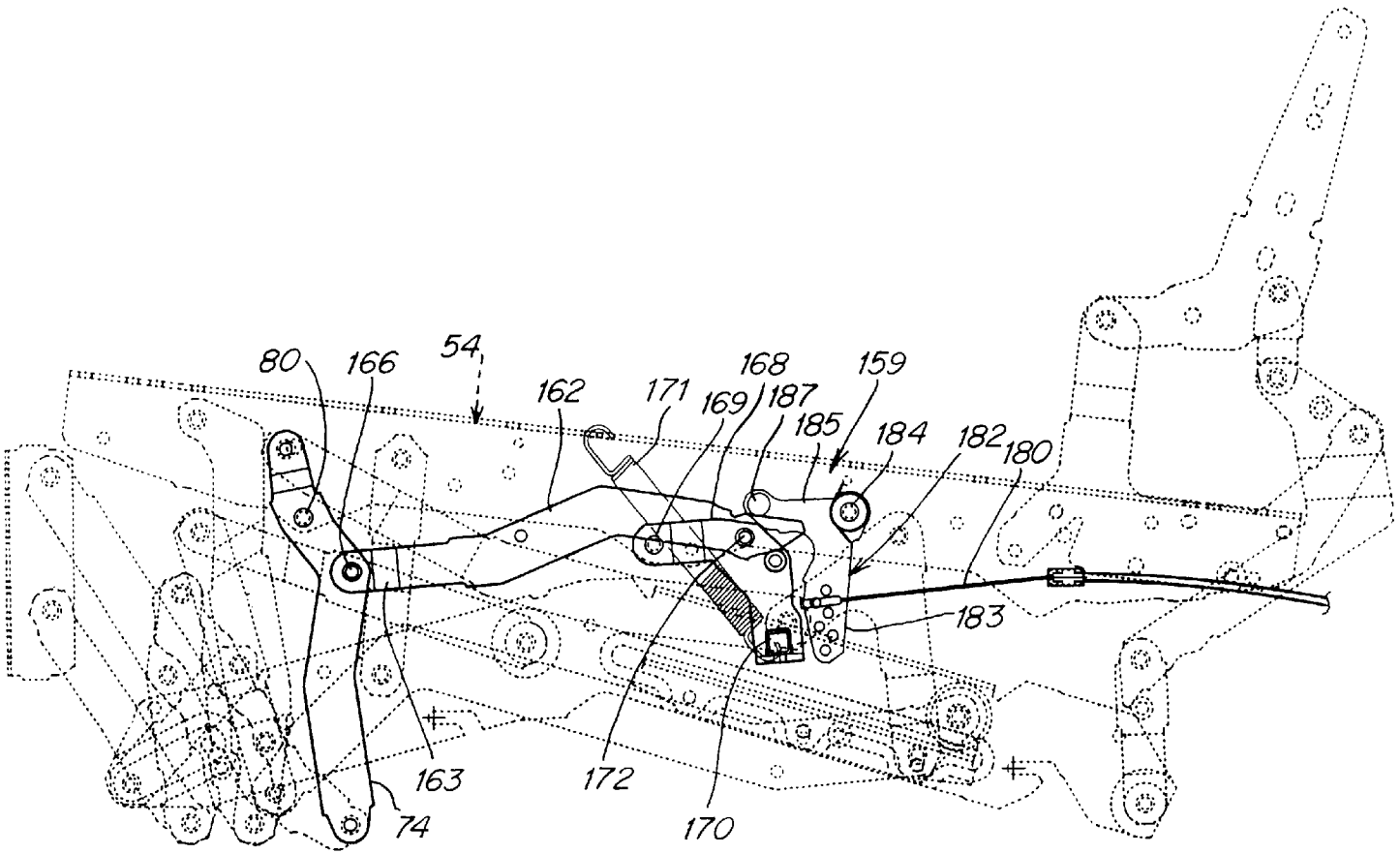
FIG. 9 is a side view of the mechanism similar to FIG. 7 and showing the footrest drive assembly retracted, and further showing the operation of the lock and cable release to retain the chair and mechanism in the upright position.
Figure 9A:
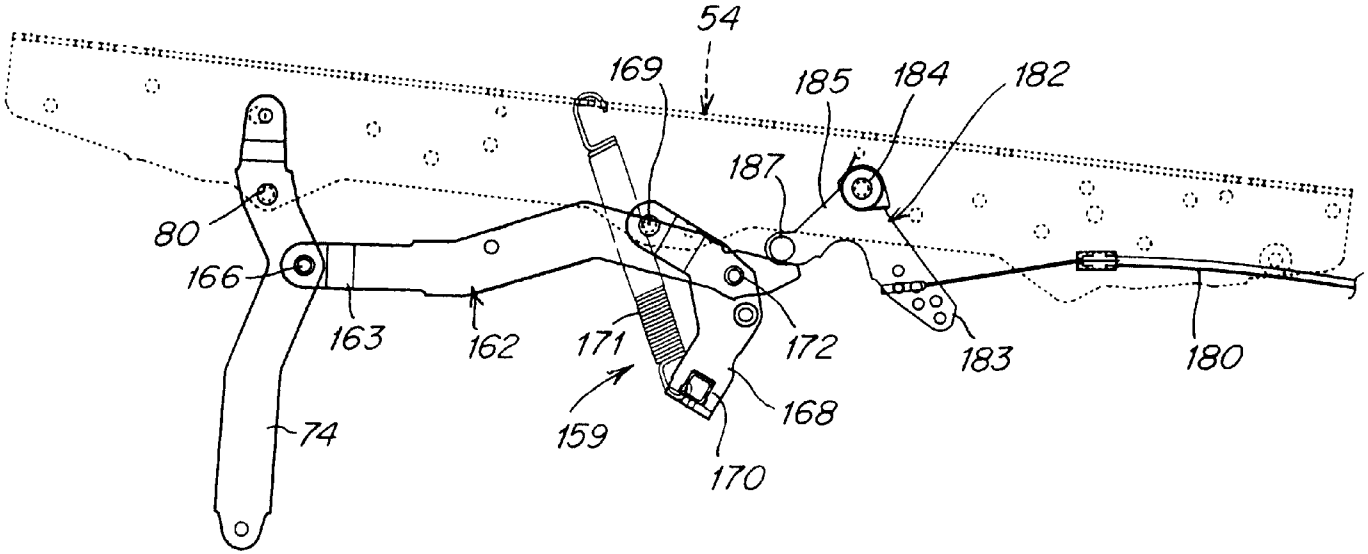
FIG. 9A is a fragmentary view of the mechanism similar to FIG. 9 but showing the lock and cable in the released position.

A linkage locking assembly 159 for retaining the mechanism 20 and thus the entire chair assembly in the upright position is shown in FIGS. 9 and 9A. The assembly 159 is pivotally connected to the seat mounting bracket 54 as described below. The locking assembly includes a lock link 162 connected at its front end 163 to the rear footrest swing link 74 at pivot 166. The other end of the footrest lock link 162 is connected by pivot 172 to a bracket 168 in turn mounted on the square cross tube 170. The bracket 168 is pivotally supported at its end opposite the square cross tube by pivot 169 on the seat mounting bracket 54. The footrest lock link 162 and bracket 168 serve as an over center latch. When the two are in the position shown in FIG. 9, the center line of spring 171 connected between the seat mounting bracket 54 and the square cross tube, lies on the side of pivot 169 urging bracket 168 to pivot counterclockwise and retain the locking link in that position and retain the footrest in the retracted position of FIGS. 1 and 4.

The locking linkage also includes a crank actuator 182 pivotally supported on the seat bracket 54 by pivot 184. The lower arm 183 of the actuator 182 is connected to a manually operated cable 180 which, when actuated, pulls the arm 183 rearwardly so as to rotate the crank actuator counterclockwise. As a result, the other arm 185 of the actuator 182 by means of a finger 187 carried by it, pushes the rear end of the footrest lock link 162 downwardly, which in turn causes the bracket 168 to turn clockwise about its pivot 169 and move the axis of the spring 171 to the other side of the pivot 169 (see FIG. 9A). This action releases the locking linkage and pushes the footrest lock link 162 in a forward direction and pivots the rear footrest swing link 74 in a clockwise direction to elevate the footrest.

Figure 2:
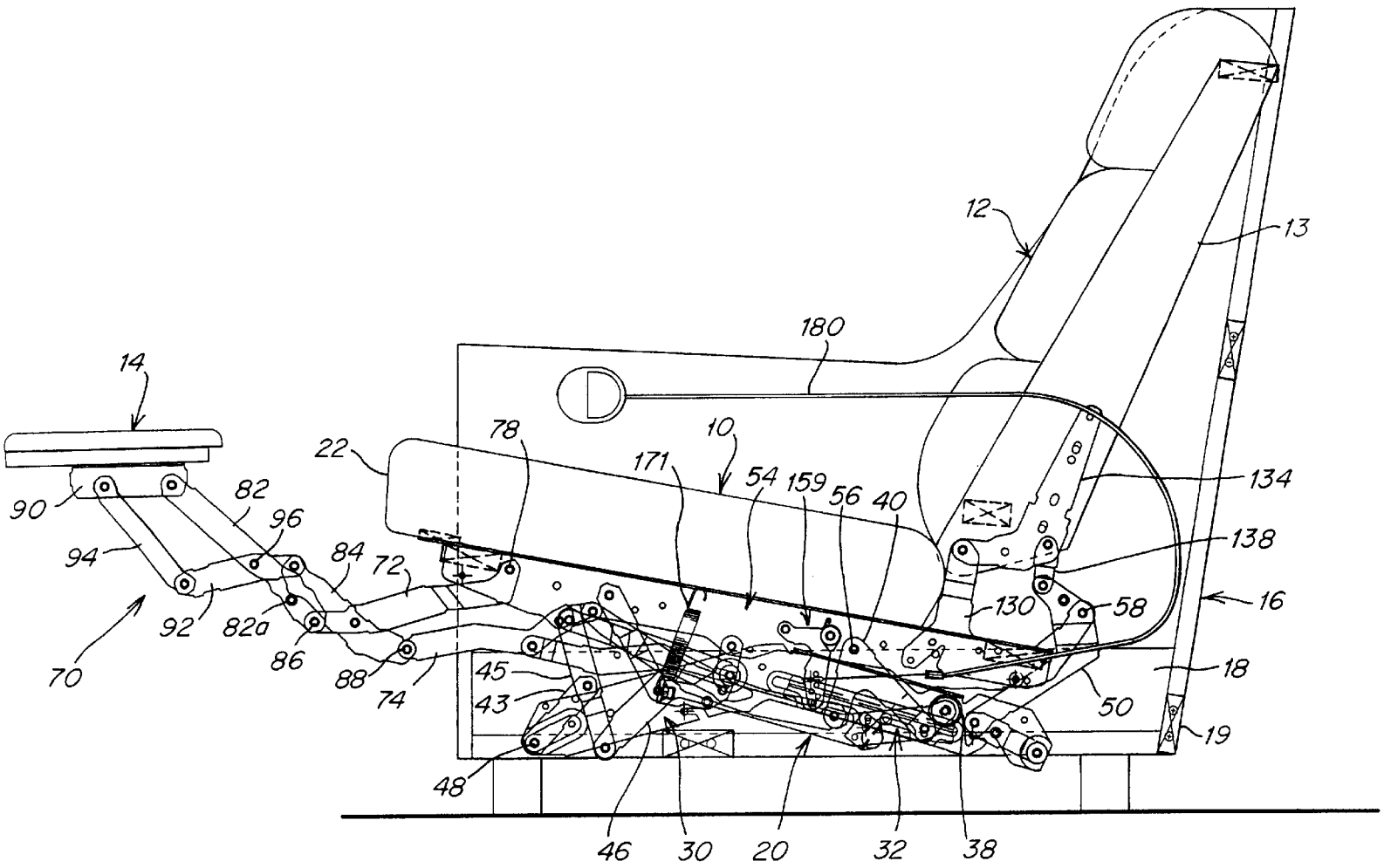
FIGS. 2 and 3 are views similar to FIG. 1 but respectively showing the chair in the intermediate and fully reclined positions.
Figure 10:
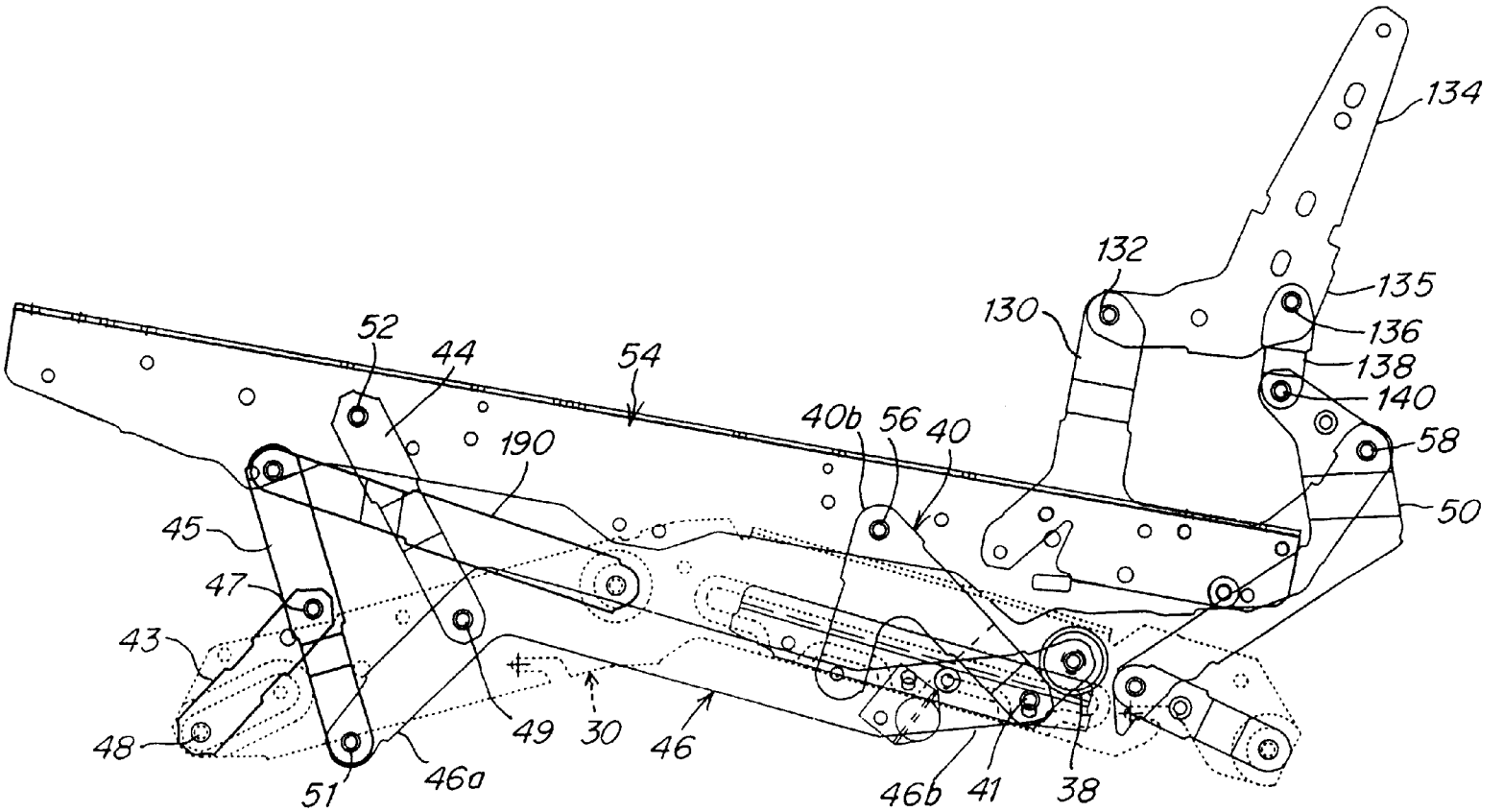
FIG. 10 is a side view of the mechanism in the intermediate or TV position highlighting the front linkage which carries the seat forward to the reclined position.

The chair mechanism described above operates as follows:

With the chair in the upright position of FIG. 1, the chair may be moved to the TV position by the occupant pulling on the cable 180 so as to cause the spring 171 of the lock assembly 159 to pass over center and release the mechanism from the locked position. A cable actuator 180*a* is mounted on a frame within easy reach of the person seated in the chair. When this occurs, the weight of the chair occupant causes the rear pivot link 40 to rotate counterclockwise from the position of FIGS. 1, 4 and 9 to the position of FIGS. 2, 5 and 10. That action moves the footrest drive link 116 rearwardly (compare FIGS. 7 and 8) causing it to pull the rear footrest swing link 74 rearwardly at the top and rotate clockwise about pivot 80 as viewed in the drawings, which in turn causes the lazy tong linkage to elevate the footrest 14. Simultaneously, the seat mounting bracket 54 moves forwardly and downwardly somewhat with respect to the mounting link 30 as rear and front pivot links 40 and 44 pivot counterclockwise on trolley 46 as viewed in the drawings. The forward travel of the seat mounting bracket is limited by the stop 82*a* on footrest link 82 engaging the lower edge of footrest link 84 as shown in FIGS. 2 and 5. In that fashion, the mechanism achieves the TV position for the seat. The backrest 12 during the transition from upright to TV position remains fixed with respect to the seat 10. When the occupant desires to move from the TV to the fully reclined position, pressure is exerted against the backrest causing the backrest mounting link 134 to pivot about point 132 on bracket 130 in a clockwise direction to the position of FIGS. 3 and 6. That action pushes the back drive link 138 in a downward direction which in turn causes the bellcrank 50 to turn in a counterclockwise direction around pivot 58 on the rear arm of horse shoe shaped bracket 130, in turn pushing forwardly on seat bracket 54, causing the seat to be moved forward along with the trolley 46. The seat 10 thus moves in a straight path forwardly and upwardly from the position of FIGS. 2 and 5 to that of FIGS. 3 and 6. The upper travel link 45 during that operation is pushed forward at its lower end by the trolley 46 which in turn causes the lower travel link 43 to rotate counterclockwise (see FIGS. 5, 6, 10 and 11). The top end of the upper travel link is limited to vertical movement only by the front control link 190. As the upper travel link 45 rotates clockwise and the lower travel link 43 rotates counterclockwise, the lower end of the upper travel link, as well as the front end of the trolley, move forwardly and upwardly in a straight line. This motion is made possible by the roller 38 which rolls to the front of track 32. So long as pressure is exerted against the backrest 12 by the occupant of the chair, the chair will remain in the fully reclined position.

To return the chair to the TV and upright positions, the chair occupant relieves the pressure on the backrest, and the occupant's weight causes the seat and backrest to return to the TV position. When in the TV position, downward pressure on the footrest 14 causes the lazy tong linkage 70 to collapse and the rear pivot link 40 to pivot in a clockwise direction about its pivot 41 on trolley 46, which in turn causes the front pivot link 44 also to pivot clockwise and the seat to move to its upright and rearward most position.

The embodiment of FIGS. 12–20 utilizes a mechanism that bears many similarities to the mechanism of the preferred embodiment of FIGS. 1–11. Both utilize a combination of track and roller together with a linkage assembly to enable the chair to move between upright, TV and fully reclined positions. While the operation of the chairs is similar to one another, the two mechanisms are different from one another and each embodiment is separately described in detail.

The incliner chair of the second embodiment includes a seat 210, backrest 212, and footrest 214, all collectively mounted on a frame 216 having side rails 218 connected together by cross rails 219. The seat, backrest and footrest are all supported on a mechanism 220 shown in detail in the drawings. The mechanism 220 enables the chair to move from the upright position shown in FIG. 12 to the intermediate or TV position shown in FIG. 13 and the fully reclined position shown in FIG. 14. When the chair moves from the upright to the TV position, the seat 210 and backrest 212 move as a unit forwardly and downwardly with respect to the frame 216, and when the chair moves from the TV to the fully reclined position, the seat 210 moves forward essentially in the plane it occupied in the TV position while the backrest tilts rearwardly with respect to the seat. The footrest 214 rises from a stored position beneath the seat when the chair is upright to an extended position beyond the front edge 222 of the seat when the chair moves from the upright to the TV position. The relative positions of the seat 210 and footrest 214 do not change as the chair continues to the fully reclined position.

As in the first embodiment, while a single mechanism is shown in the drawings, it should be appreciated that duplicate mechanisms are mounted on each side of the chair. The two mechanisms are mirror images of one another and work together as the chair moves to each of its three positions. In the following description only a single mechanism is described.

The mechanism 220 is carried by a mounting link 230 which is secured to the inner surface of the side panel 218 of the frame 216. The mounting link 230 is made of steel, as are all the other elements of the mechanism, and is bolted to the side panel 218. The mounting link 230 carries a track 232 on its inner face defined in part by an angle member 234 riveted to the mounting link and by a flange 236 formed as an integral part of the link 230. The track 232 is upwardly and forwardly inclined with respect to the chair and carries a roller 238 which may move from the rearward most position shown in FIGS. 12 and 15, in a forward direction up the track to the extreme forward position shown in FIGS. 14 and 17. The roller 238 in turn carries a rear pivot link 240 pivotally mounted on the shaft 242 of the roller.

A front pivot link 244 is pivotally mounted on the front lower end 246 of the mounting link 230 at pivot 248. The opposite end of front pivot link 244 is pivotally connected at pivot 252 to the front lift link 250. The front lift link 250 and the rear pivot link 240 together support the seat mounting bracket 254. The rear pivot link 240 which is crank-shaped is connected to the rear portion of the seat mounting bracket 254 at pivot 256 while the front lift link 250 which is also crank-shaped is connected to the seat mounting bracket at pivot 258 located at the elbow 260 of the front lift link (see FIGS. 16 and 17).

The footrest 214 is carried by a lazy tong linkage 270 that is essentially the same as the lazy tong linkage 70 of the first embodiment. It is made up of front and rear footrest swing links 272 and 274 both pivotally mounted on the front end 276 of the seat mounting bracket 254 at 278 and 280, respectively. The swing links 272 and 274 are in turn pivotally connected at their ends to links 282 and 284 at pivots 286 and 288. The link 282 in turn is connected at its other end to the footrest mounting bracket 290. The other end of link 284 is connected to a pair of folding links 292 and 294. The link 294 in turn is also connected to the footrest mounting bracket 290. The links 282 and 292 are interconnected by pivot 296 intermediate their ends, and the front swing link 272 and the link 284 are connected intermediate their ends by pivot 298. The lazy tong linkage acts as a pantograph to move the footrest from a retracted position beneath the seat (FIGS. 12 and 15) to an extended position generally in the plane of the seat and forward of the front portion 222 thereof.

Figure 17:
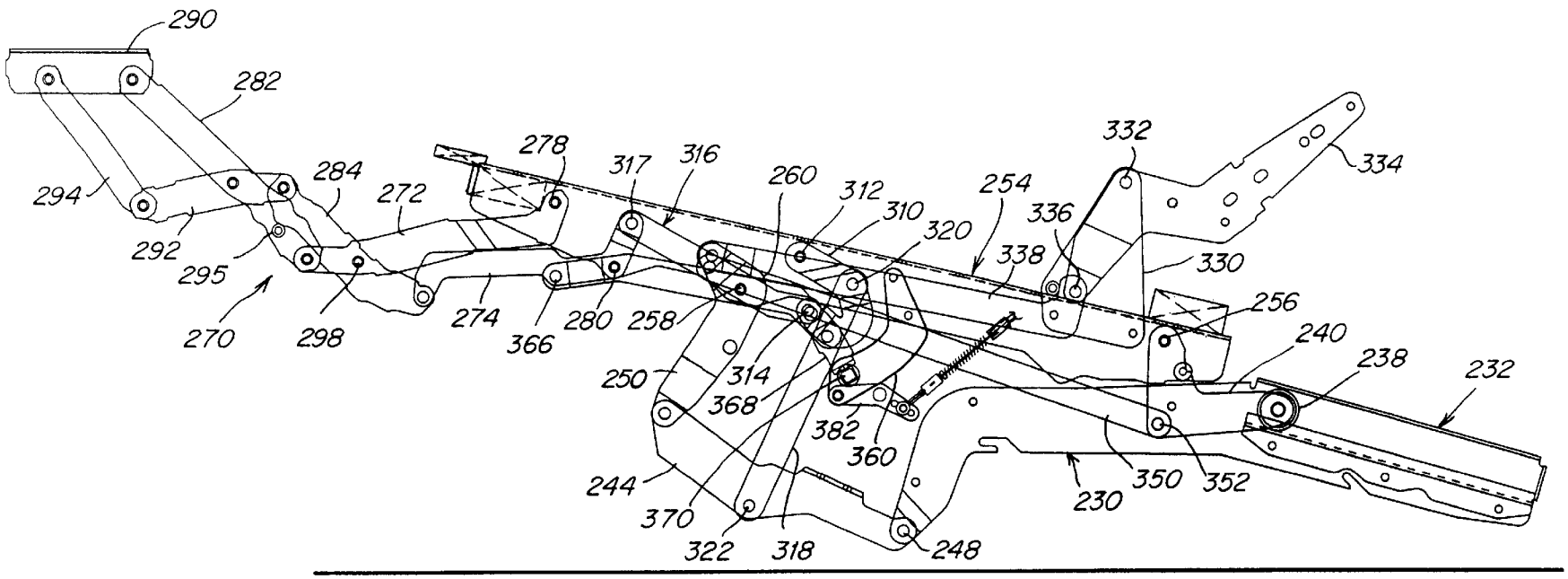
Figure 18:
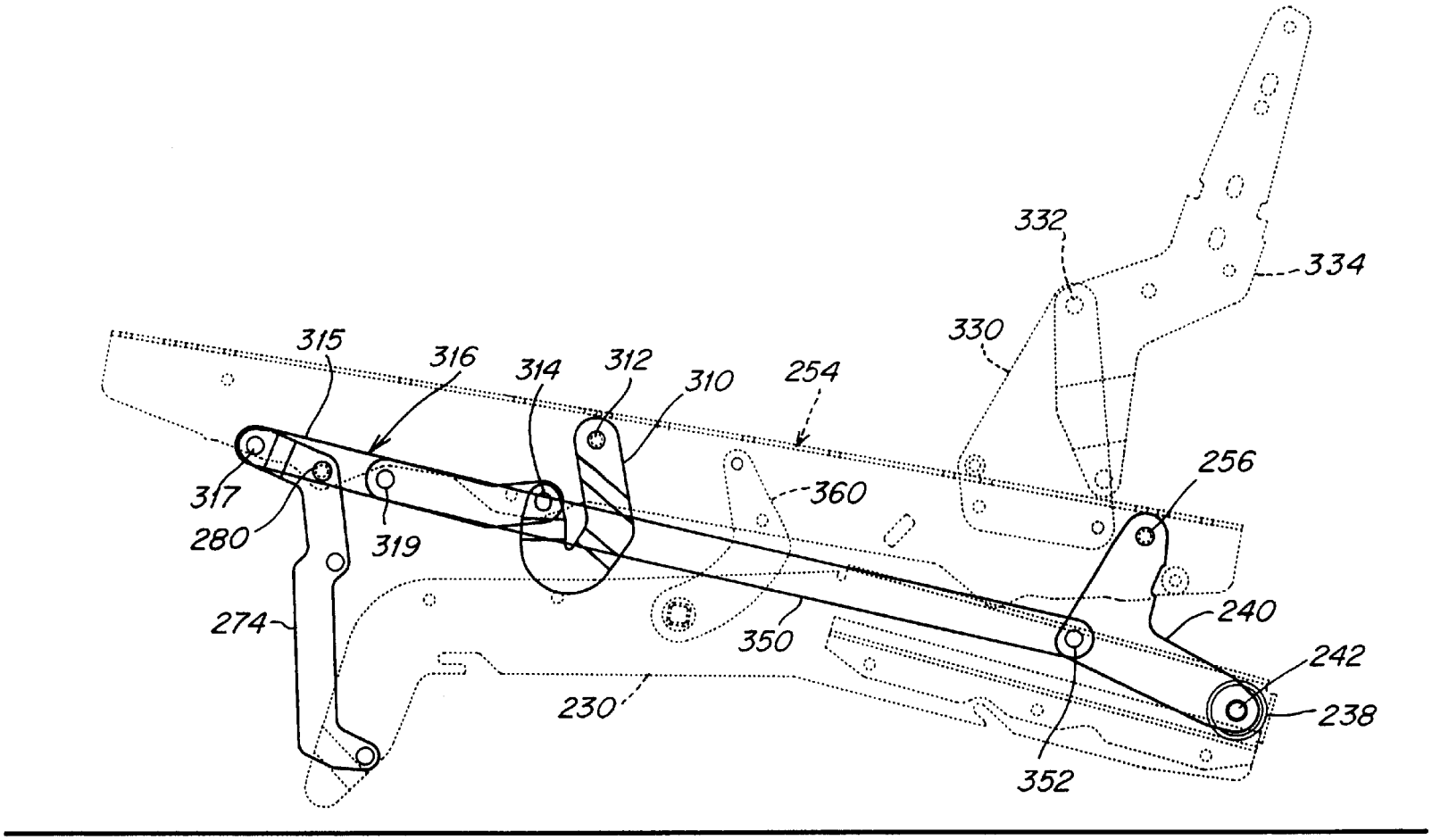
FIG. 18 is a fragmentary side view of the mechanism shown in FIGS. 12–17 and particularly featuring the footrest drive assembly and with the mechanism in the footrest retracted position.
Figure 19:
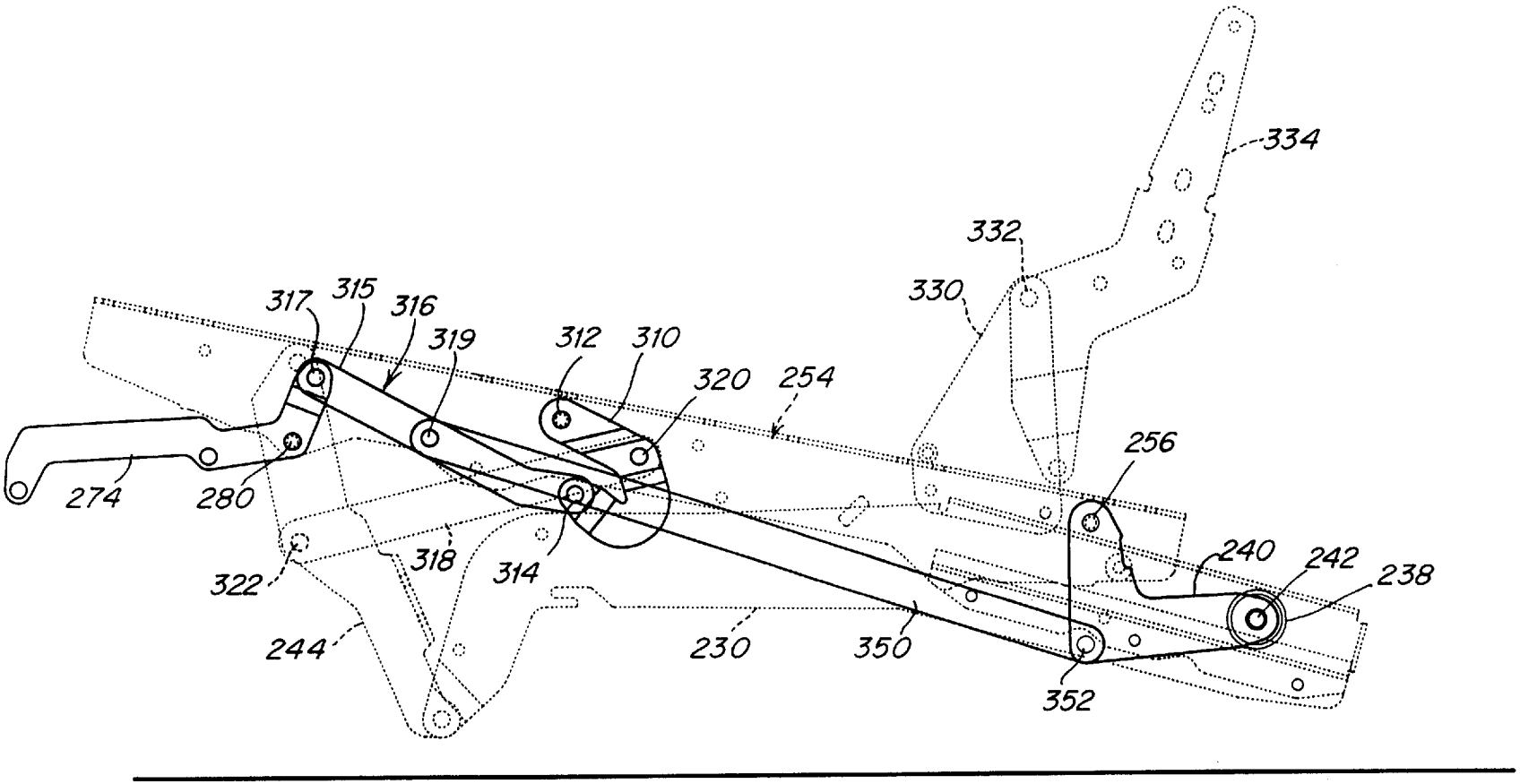
FIG. 19 is a view similar to FIG. 18 but with the mechanism in the intermediate position and with the footrest drive assembly extended.

A bell crank 310 is pivotally mounted at one end on the seat mounting bracket 254 at 312, and the other end of the crank is pivotally connected at 314 to the footrest drive link 316 which in turn is pivotally connected at its front end 315 by pivot 317 to the rear footrest swing link 274 as is most clearly shown in FIGS. 17–19. Intermediate its ends, the bell crank 310 is connected to the front control link 318 at pivot 320. The other end of the front control link 318 is pivotally connected at 322 to the front pivot link 244.

Figure 15:
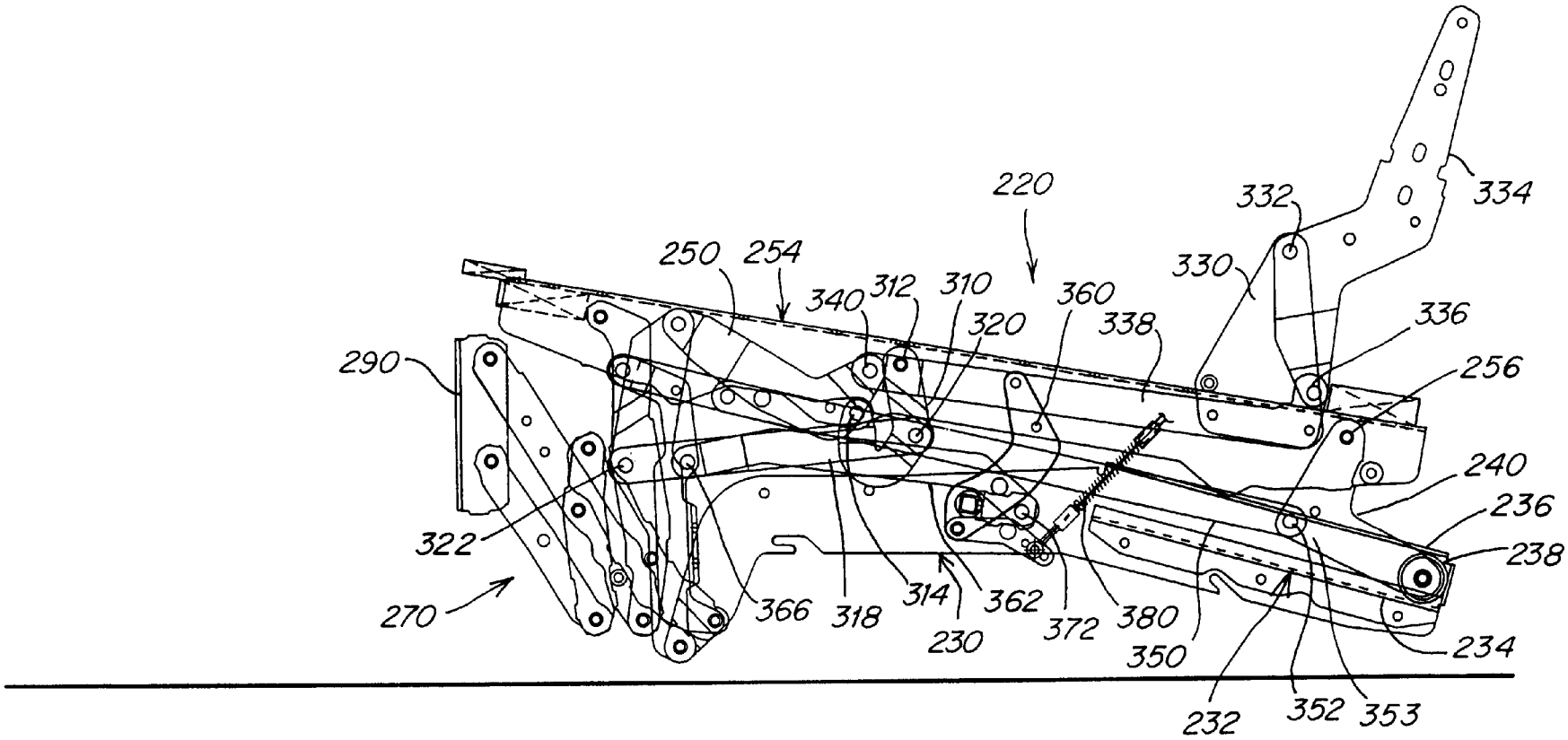
FIGS. 15–17 are enlarged side views of the mechanism shown in FIGS. 12–14 and with the mechanism in the upright, intermediate (TV) and fully reclined positions, respectively.
Figure 16:
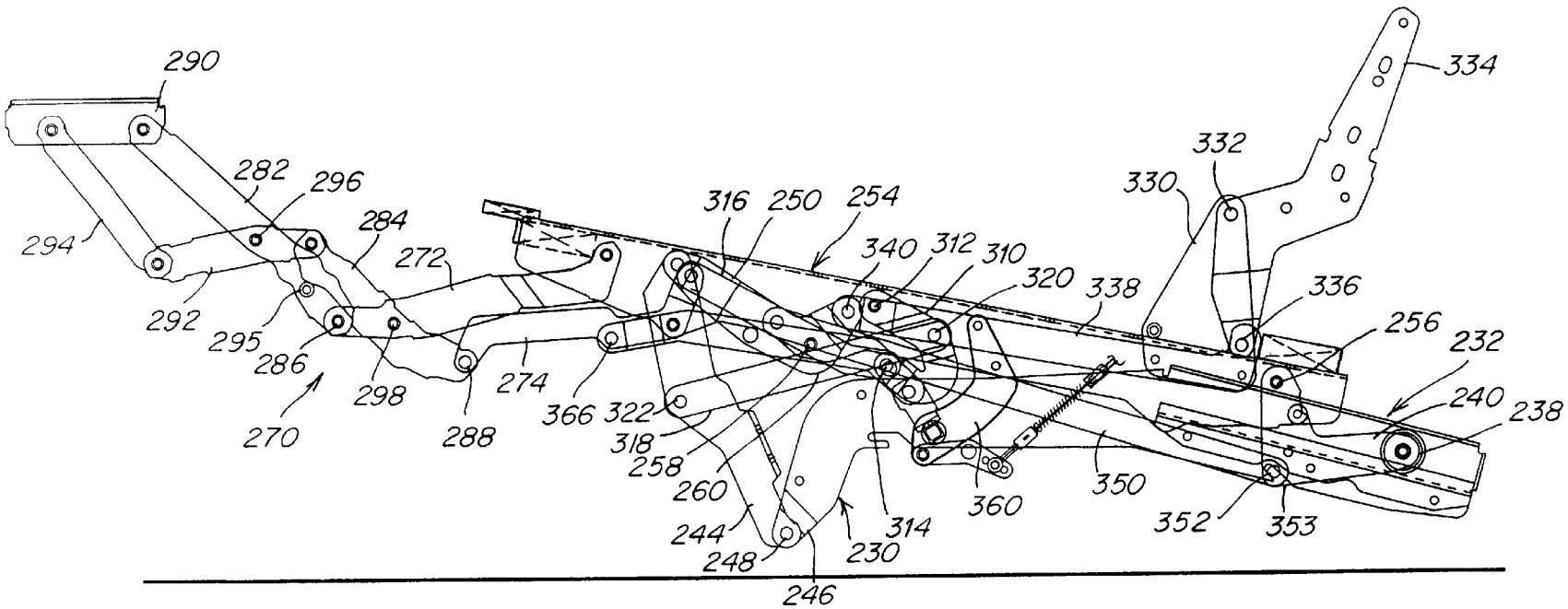

Adjacent its back end, the seat mounting bracket 254 carries a generally triangular-shaped shaped fixed bracket 330 which is riveted to and moves with the seat mounting bracket (see FIGS. 15–17). The bracket 330 at its upper end by means of pivot 332 pivotally supports the backrest mounting link 334 which in turn carries the backrest 212 with its frame (not shown). The lower end of the backrest mounting link 334 is pivotally connected at 336 to the rear end of the back drive link 338 in turn connected at its front end by pivot 340 to one end of the front lift link 250. A pivot 352 located at the elbow 353 of the rear pivot link 240 joins the rear pivot link to a rear control link 350. The forward end of the rear control link 350 is connected at pivot 315 to the midsection of footrest drive link 316 (see FIG. 19). Thus, the footrest drive link 316 and rear control link 350 form continuations of each other although their angular relationship to one another varies slightly as the mechanism 220 moves from the upright to the TV and fully reclined positions. The rear control link 350 controls the rotational motion of the rear pivot link 240 as is described more fully below in connection with the operation of the mechanism.

Figure 20:
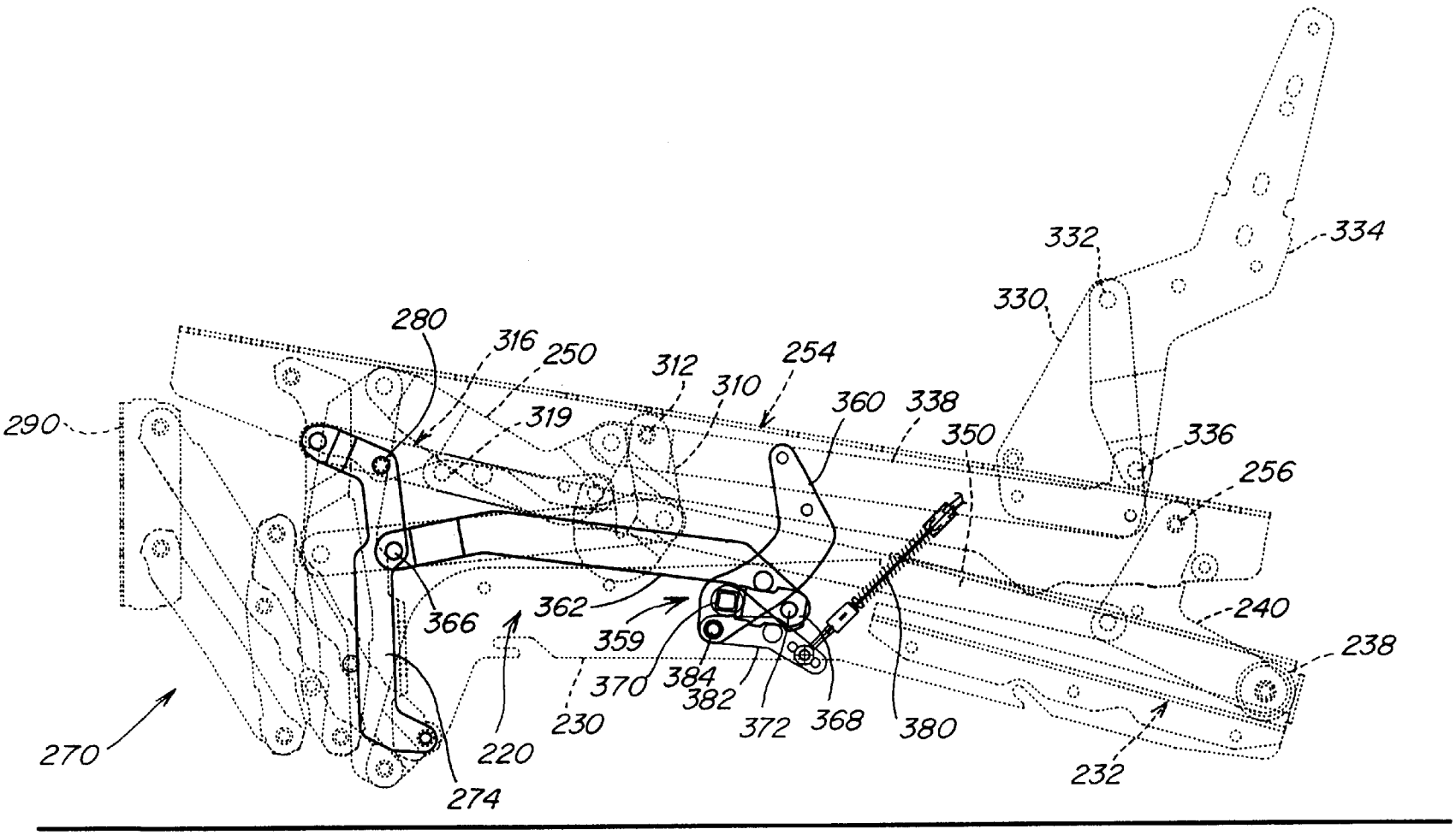
FIG. 20 is a side view of the mechanism in the upright position and highlighting the operation of the mechanism lock and cable release.

A linkage locking assembly 359 for retaining the mechanism 220 and thus the entire chair assembly in the upright position is shown in FIG. 20. The assembly 359 is mounted on an extension bracket 360 fixed to the seat mounting bracket 254. The locking assembly 359 also includes a lock link 362 connected to the rear footrest swing link 274 at pivot 366. The other end of the lock link 362 is connected to a bracket 368 mounted on the square cross tube 370 in turn supported on the extension bracket 360. The connection between the footrest lock link 362 and the bracket 368 is shown at 372. The footrest lock link 362 and bracket 368 together form an over center latch. When the two are folded about the pivot 372 to the position shown in FIG. 20, the center of the pivot 372 lies over the center line defined by the square cross tube 370 and the pivot 366 joining the footrest lock link to the rear footrest swing link 274 so as to retain the footrest in the retracted position of FIGS. 12, 15 and 20 and prevents the mechanism 220 from moving. When the pivot 372 passes across the center line defined by pivot 366 and tube 370, the mechanism 220 is unlocked and may move from the upright position to the TV position of FIGS. 13 and 16 and further to the fully reclined position of FIGS. 14 and 17. A cable 380 shown in FIG. 20 is secured to an actuator 382 pivoted at 384 on the fixed bracket 360, which in turn engages the bracket 368 and lifts it about the axis of the square tube 370 so as to carry the pivot 372 over center. The chair under the weight of the occupant will then move to the intermediate position.

Figure 12:
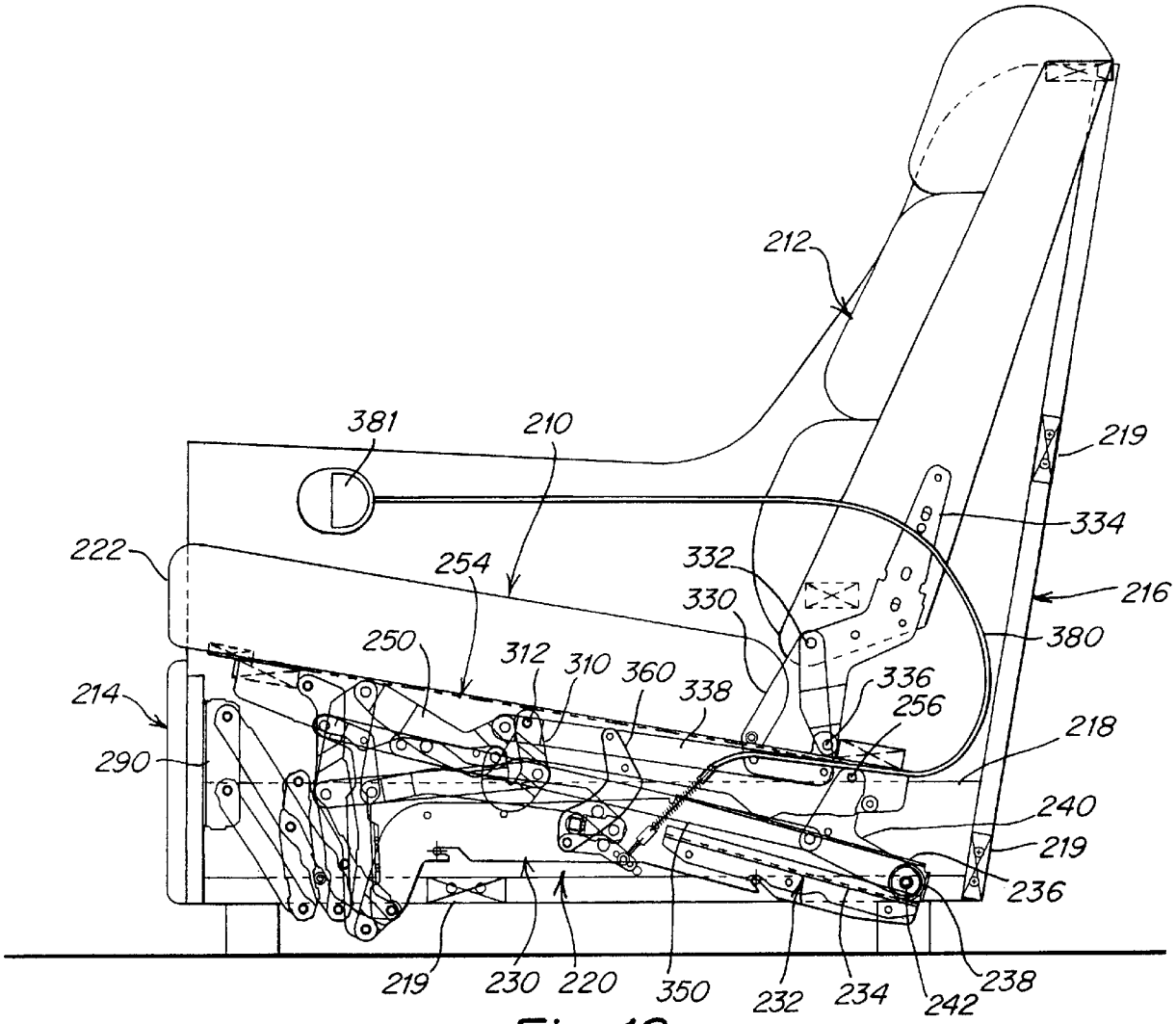
FIG. 12 is a side view of another embodiment of the three-way incliner chair constructed in accordance with the present invention and with the backrest, seat and footrest shown diagrammatically and with the incliner mechanism shown in detail and further with the chair in the upright position.
Figure 13:
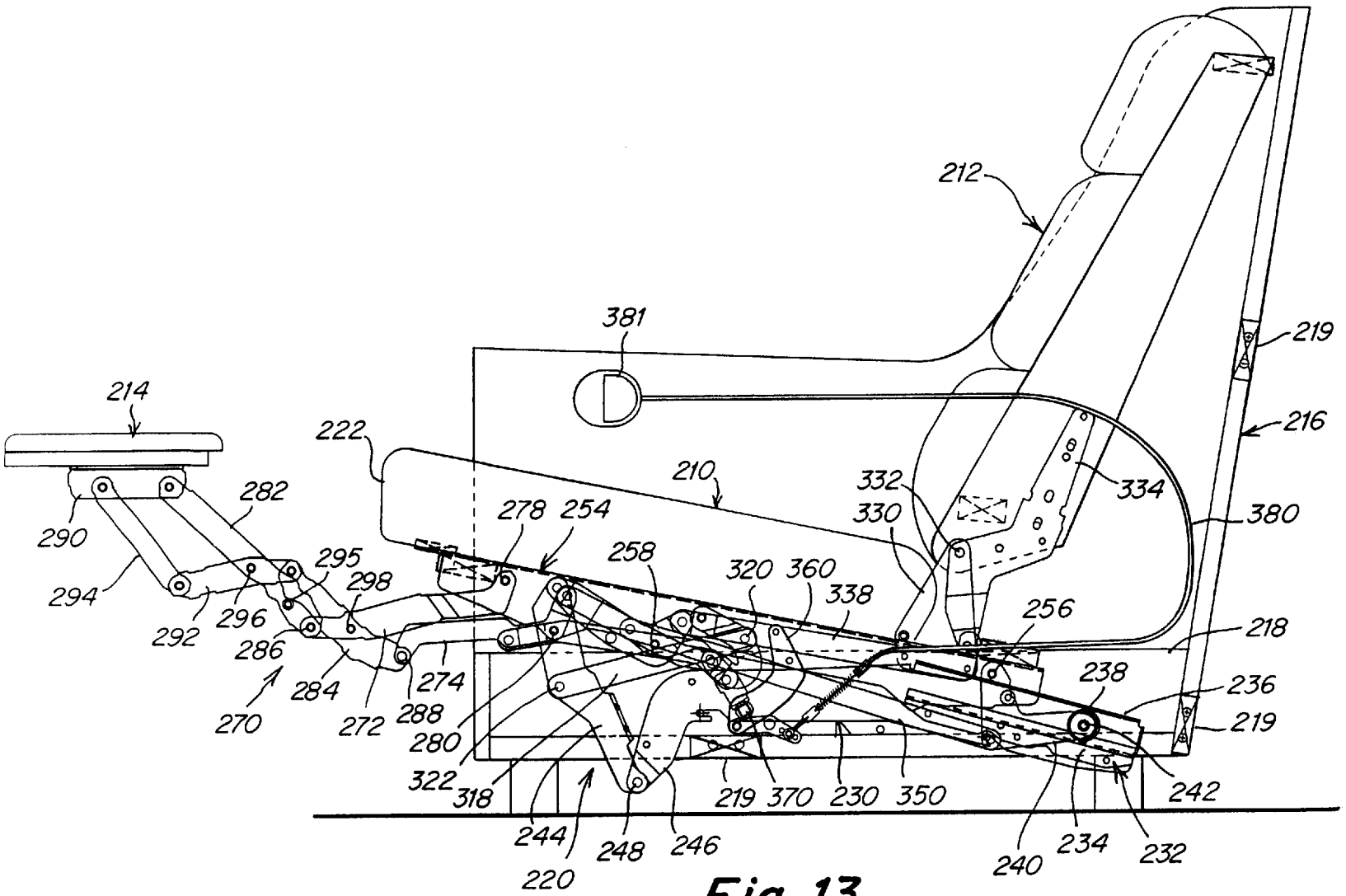
FIGS. 13 and 14 are views similar to FIG. 12, but respectively showing the chair in the intermediate and fully reclined positions.
Figure 14:
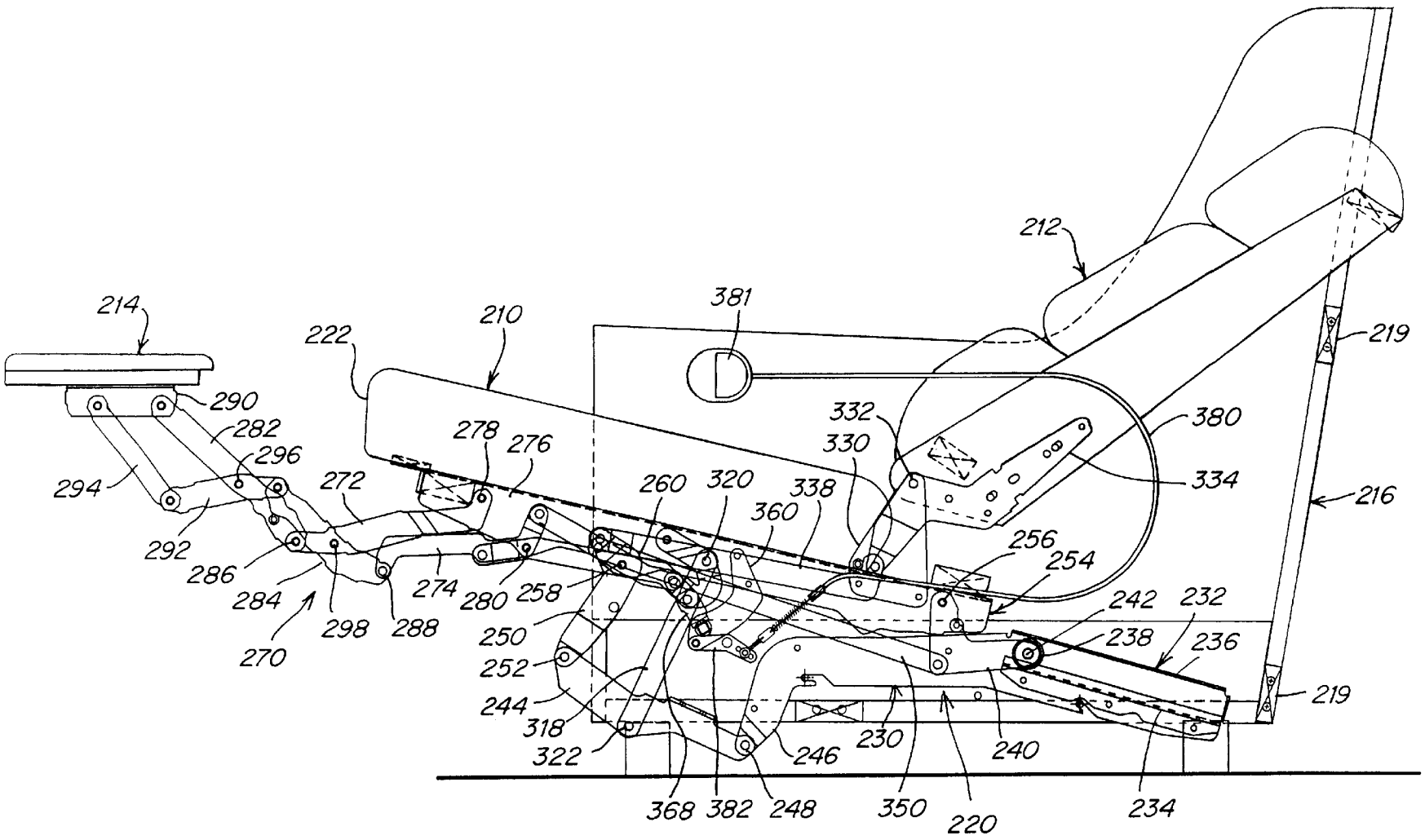

The chair mechanism of the second embodiment operates as follows:

With the chair in the upright position of FIG. 12, the chair may be moved to the TV position by the occupant pulling on the cable 380 by means of a handle, button or other well-known actuator suggested at 381 on the arm of the chair in easy reach of the chair occupant, so as to cause the pivot 372 of the lock assembly 359 to pass over center. When this is done, the weight of the chair occupant causes the front pivot link 244 to rotate counterclockwise from the position of FIGS. 12 and 15 to the position of FIGS. 13 and 16. That action moves the front control link 318 counterclockwise toward the vertical position and turns the crank 310 counterclockwise. The counterclockwise motion of the crank 310 pulls the upper end of rear footrest swing link 274 causing it, through footrest drive link 316, to rotate clockwise (see FIGS. 18 and 19) which in turn opens the lazy tong linkage 270 and elevates the footrest 214. Simultaneously, the seat mounting bracket 254 moves forwardly and downwardly somewhat with respect to the mounting link 230 about pivot 256 as rear control link 350 pivots the rear pivot link 240 about pivot 256 in a counterclockwise direction. Because the effective length of the front pivot link 244 is greater than the effective length of the rear pivot link 240 measured between pivot points 352 and 356, the roller 238 which supports the rear pivot link is caused to move forwardly and upwardly in the track from the rearward most position shown in FIGS. 12 and 15 to the intermediate position shown in FIGS. 13 and 16. The forward travel of the seat mounting link is limited by the stop 295 on link 282 which engages the edge of link 284 when the lazy tong linkage is fully extended as shown in FIG. 16. In that fashion, the mechanism and chair assembly achieve the TV position. The backrest 212 during that transition remains fixed with respect to the seat 210 (note FIGS. 12 and 13). When the occupant desires to move from the TV position to the fully reclined position, pressure is exerted against the backrest causing it to pivot about point 332 on bracket 330 in a clockwise direction to the position of FIGS. 14 and 17. That action pushes the back drive link 338 in a forward direction which causes the front lift link 250 to turn in a counterclockwise direction around pivot 258, in turn causing the front pivot link 244 to pivot further in a counterclockwise direction and move seat mounting bracket 254 and the seat 10 in a straight path forwardly and upwardly from the positions of FIGS. 13 and 16 to that of FIGS. 14 and 17. The front control link 318 during that operation is pulled by the front pivot link 244 counterclockwise about the pivot 320 causing the seat to move in a straight path which also causes the roller 238 to travel to the front end of the track 232. So long as pressure is exerted against the backrest by the chair occupant, the chair will remain in the fully reclined position.

To return to the chair to the TV and upright positions, the occupant relieves the pressure on the backrest and the occupant's weight causes the seat and backrest to return to the TV position. When in the TV position, downward pressure on the footrest 214 causes the lazy tong linkage 270 to collapse and the crank 310 to pivot in a clockwise direction about its pivot 312 which in turn causes the front and rear pivot links 244 and 240 to pivot clockwise and the roller 238 to return to the rearward most position on track 232.

Each of the embodiments illustrated and described provides the advantages of both categories of reclining chair mechanisms found in the prior art. The mechanism is somewhat less expensive than a pure linkage capable of performing a similar function, and the mechanism increases the dimension tolerances allowed in the construction of the frame over what is required in a chair made of pure roller and track mechanism. Moreover, the track and roller subassembly provides a very smooth and easy operation in the transition from the upright to the reclined positions.

Having described two embodiments of this invention in detail, those skilled in the art will appreciate that modifications may be made of each without departing from the spirit and scope of the invention. Therefore, it is not intended that the scope of the invention be limited to the specific embodiments illustrated and described. Rather, its scope is to be determined by the appended claims and their equivalents.

What is claimed is:

1. A three-way incliner chair having a seat and backrest comprising a frame having a pair of side members connected together by cross members, said frame intended to support the chair, a pair of incliner mechanisms, one mounted on each of the side members and together carrying the seat and backrest for movement between upright, TV and fully reclined positions, each of said mechanisms including a mounting link having front and back ends and connected to one of the side members, a track and roller assembly mounted adjacent the back end of the mounting link, said roller carrying a rear pivot link, a front pivot link pivotally mounted at one end on and adjacent the front of the mounting link and a front lift link pivotally connected to the other end of the front pivot link, a seat mounting link pivotally supported at its back on the rear pivot link and at its front intermediate the ends of the front lift link enabling the seat to move forwardly with respect to the frame from an upright position to the TV and fully reclined positions, a footrest and a footrest linkage assembly carrying the footrest and mounted adjacent the front end of the seat mounting link, said linkage assembly moving the footrest between retracted and extended positions, a bell crank pivotally mounted at one end to the seat mounting link, a footrest drive link pivotally connected at one end to the footrest linkage assembly and at its other end to the bell crank for actuating the footrest linkage assembly and extending the footrest, a front control link connected between the bell crank and front pivot link for turning the bell crank to in turn move the footrest drive link so as to extend the footrest when the seat moves forward from the upright to the TV position, a backrest link pivotally mounted on the seat mounting link and carrying the backrest rearwardly with respect to the seat in response to backward pressure exerted by a chair occupant against the backrest, and a backrest drive link connected between the backrest link and front lift link for moving the seat in a forward direction from the TV position to the fully reclined position when the backrest moves rearwardly on the seat mounting link.

2. A three-way incliner as defined in claim 1 wherein a footrest locking bracket is pivotally movable on a pivot fixed with respect to the seat mounting link, and a footrest lock link is connected between the locking bracket and footrest linkage assembly for locking the seat in the upright position.

3. A three-way incliner as defined in claim 2 wherein a lock release assembly is connected to the locking bracket for unlocking the seat to enable it to move from the upright to the TV position.

4. An incliner chair having a seat and backrest comprising a frame and a pair of mechanisms one mounted on each side of the frame and extending fore and aft thereof, each mechanism including a mounting link connecting the mechanism to the frame and carrying a roller and track adjacent the rear thereof, a seat mounting bracket, a pivot link connected to the roller and the rear of the seat mounting bracket, a front linkage pivotally mounted by a fixed pivot to the front of the mounting link and pivotally connected to the front of the seat mounting bracket, a footrest and footrest linkage assembly carrying the footrest and mounted on the seat mounting bracket for extending and retracting the footrest with respect to the seat, a first drive linkage pivotally connected to the seat mounting bracket and footrest linkage assembly for extending the footrest in response to forward travel of the seat mounting bracket with respect to the mounting link, a backrest and backrest link carrying the backrest and pivotally mounted on the seat mounting bracket for enabling rearward travel of the backrest relative to the seat, and a second drive linkage connected between the backrest link and the front linkage for moving the seat mounting bracket forwardly on the track and front linkage in response to the rearward travel of the backrest with respect to the seat.

5. An incliner as defined in claim 4 wherein the first drive linkage is also connected to the rear pivot link causing the roller to ride forwardly on the track in response to extension of the footrest.

6. An incliner as defined in claim 5 wherein the second drive linkage causes the roller to move further forwardly on the track in response to rearward travel of the backrest relative to the seat.

7. An incliner as defined in claim 4 wherein a locking linkage is connected to the seat mounting bracket and the footrest linkage for releasably preventing the footrest linkage from extending the footrest.

8. An incliner as defined in claim 7 wherein the locking linkage includes an over center latch and a cable for moving the latch from a locking position to a release position.

9. A three-way incliner chair having a seat and backrest comprising a frame having a pair of side members connected together by cross members, said frame forming a base for the chair, a pair of incliner mechanisms, one mounted on each of the side members and together carrying the seat and backrest for movement between upright, TV and fully reclined positions, each of said mechanisms including a mounting link having front and back ends and connected to one of the side members, a single track and roller assembly mounted adjacent the back end and a travel linkage pivotally mounted by a fixed pivot on the front end of the mounting link, a trolley having a back end carried by the roller assembly and a front end carried by the travel linkage, front and rear pivot links pivotally mounted on the trolley, a seat mounting link pivotally supported at its back on the rear pivot link and at its front on the front pivot link enabling the seat to move forwardly with respect to the frame from an upright position to the TV and fully reclined positions, a footrest and a footrest linkage assembly carrying the footrest and mounted adjacent the front end of the seat mounting link, said linkage assembly moving the footrest between retracted and extended positions, a footrest drive link pivotally connected at one end to the footrest linkage assembly and at its other end to the rear pivot link for actuating the footrest linkage assembly and extending the footrest when the seat moves forwardly from the upright to the TV position as the trolley remains fixed on the mounting link, a backrest linkage pivotally mounted on the seat mounting link and carrying the backrest rearwardly with respect to the seat in response to backward pressure exerted by a chair occupant against the backrest, and a backrest drive linkage connected between the backrest linkage and mounting link for moving the seat mounting link and seat in a forward direction with respect to the frame when the backrest moves rearwardly with respect to the seat.

10. A three-way incliner chair having a seat and backrest comprising a frame having a pair of side members connected together by cross members, said frame forming a base for the chair, a pair of incliner mechanisms being mirror images of one another, one mounted on each of the side members and together carrying the seat and backrest for movement between upright, TV and fully reclined positions, each of said mechanisms including a mounting link having front and back ends and connected to one of the side members, a track and roller assembly mounted adjacent the back end of the mounting link, said roller carrying a trolley, front and rear pivot links pivotally mounted on the trolley, a seat mounting link pivotally supported at its back on the rear pivot link and at its front on the front pivot link enabling the seat to move forwardly with respect to the frame from an upright position to the TV and fully reclined positions, a footrest and a footrest linkage assembly carrying the footrest and mounted adjacent the front end of the seat mounting link, said linkage assembly moving the footrest between retracted and extended positions, a footrest drive link pivotally connected at one end to the footrest linkage assembly and at its other end to the rear pivot link for actuating the footrest linkage assembly and extending the footrest when the seat moves forwardly from the upright to the TV position, a backrest linkage pivotally mounted on the seat mounting link and carrying the backrest rearwardly with respect to the seat in response to backward pressure exerted by a chair occupant against the backrest, a backrest drive linkage connected between the backrest linkage and mounting link for moving the seat mounting link and seat in a forward direction with respect to the frame when the backrest moves rearwardly with respect to the seat, a footrest locking bracket is pivotally movable on a pivot fixed with respect to the seat mounting link, and a footrest lock link is connected between the locking bracket and footrest linkage assembly for locking the seat in the upright position.

11. A three-way incliner as defined in claim 10 wherein a lock release actuator engages the lock link for unlocking the footrest linkage to enable the seat to move from the upright to the TV position.

12. An incliner chair comprising;

a frame and a reclining mechanism mounted on the frame, a seat, backrest and footrest carried by the mechanism and enabling the seat and backrest to move from an upright position to a TV position and a fully reclined position and the footrest to move from a retracted position when the seat and backrest are in the upright position to an extended position when the seat and backrest are in the TV and fully reclined positions, said mechanism including a mounting bracket attached to and extending fore and aft on the frame, said bracket having front and rear portions, a track and roller mounted on the rear portion of the bracket, a pivotally movable linkage mounted with a fixed pivot on the front portion of the bracket, a seat mounting link carrying the seat and supported at its front by the linkage, means including the track and roller supporting the seat mounting link at its back, a backrest link carrying the backrest pivotally mounted on the seat mounting link, a footrest linkage carrying the footrest and mounted on the seat mounting link, a locking mechanism operatively connected to the footrest linkage for selectively preventing the footrest from being extended and the seat mounting link and seat from moving forwardly to the TV position, and a control linkage connected to the backrest link and responsive to pivotal movement of the backrest relative to the seat for moving the seat in a forward direction from the TV to the fully reclined position.

13. An incliner chair as defined in claim 12 wherein the pivotally movable linkage and means including the track and roller enabling the seat to move in response to gravity from the upright to the TV position if the locking mechanism is disabled.

14. An incliner chair having a seat and backrest comprising a frame and a pair of mechanisms mounted on each side of the frame and extending fore and aft thereof, each mechanism including a mounting link connecting the mechanism to the frame and carrying a roller and track adjacent the rear thereof, a seat mounting bracket, a trolley mounted at its rear on the roller and a rear pivot link connected to the trolley and the rear of the seat mounting bracket, a roller-free linkage connecting the front of the trolley at a fixed pivot point on the mounting link, a front linkage pivotally connected to the front of the trolley and front of the seat mounting bracket, a footrest and footrest linkage carrying the footrest and mounted on the seat mounting bracket for extending and retracting the footrest with respect to the seat, a drive linkage pivotally connected to the seat mounting bracket and footrest linkage for extending the footrest in response to forward travel of the seat mounting bracket with respect to the mounting link while the roller remains stationary in the track, a backrest linkage carrying the backrest and pivotally mounted on the seat mounting bracket for enabling the backrest to tilt rearwardly with respect to the seat, and a second drive linkage connected between the backrest linkage and the mounting link for moving the seat mounting bracket forwardly with the trolley on the track and front linkage relative to the frame in response to the rearward tilting of the backrest with respect to the seat.

15. An incliner chair as defined in claim 14 wherein a locking mechanism mounted on the seat mounting bracket releasably locks the footrest linkage to prevent the seat from moving in a forward direction with respect to the mounting bracket.

16. An incliner chair as defined in claim 15 wherein the locking mechanism includes an over center latch for locking the first recited drive linkage and an actuator for moving the over center latch to release said first recited drive linkage.

17. An incliner chair as defined in claim 14 wherein the second drive linkage causes the roller to move forwardly in the track as the backrest tilts rearwardly with respect to the seat.

* * * * *